United States Patent [19]

Rathjen

[11] Patent Number: 4,924,565

[45] Date of Patent: May 15, 1990

[54] BODY CONTAINER

[76] Inventor: Fordyce Rathjen, 1500 Hwy 310, Manitowoc, Wis. 54220

[21] Appl. No.: 329,523

[22] Filed: Mar. 28, 1989

[51] Int. Cl.[5] ..... A61G 17/00

[52] U.S. Cl. ..... 27/7; 27/11

[58] Field of Search ..... 27/2–11, 27/19

[56] References Cited

U.S. PATENT DOCUMENTS

| | | | |
|---|---|---|---|
| 2,708,301 | 8/1955 | Wilkirson . | |
| 3,045,314 | 7/1962 | Miller . | |
| 3,050,817 | 8/1962 | Pare | 27/7 |
| 3,164,880 | 1/1965 | Hotchkiss | 27/7 X |
| 3,283,386 | 11/1966 | Cenegy | 27/3 |
| 3,892,417 | 7/1975 | Clayton . | |
| 4,759,104 | 7/1988 | Buerosse . | |

FOREIGN PATENT DOCUMENTS

| | | | |
|---|---|---|---|
| 1234927 | 2/1967 | Fed. Rep. of Germany | 27/11 |
| 1061978 | 3/1967 | United Kingdom | 27/7 |

*Primary Examiner*—Richard E. Chilcot, Jr.
*Attorney, Agent, or Firm*—Thomas D. Wilhelm

[57] ABSTRACT

Body container and processes for use with the bodies of the deceased. The body container comprises an enclosure. The enclosure is sealable to form a seal, and is effective to prevent gases from being transmitted freely into or out of the body container. The body container includes one or more valves for facilitating transmission of gases through the enclosure at the valve. The valve can permissively be a one-way valve, a pair of one-way valves, or a two-way valve. The body container can be sealed by an adhesive between the lid and receptacle. Those embodiments having a lid and a receptacle can have a hinge joining the lid, the hinge desirably being laterally supported but vertically floating.

23 Claims, 2 Drawing Sheets

BODY CONTAINER

BACKGROUND OF THE INVENTION

This invention pertains to body containers. It pertains particularly to body containers which are to be used for bodies which are either diseased, or have so much breakage or decomposition as to prevent normal embalming.

It is anticipated by the inventor herein that there are risks involved in handling deceased human bodies. Where the deceased person has been diseased, and especially diseased with a communicable disease, it is anticipated that there is some risk of communicating the disease to anyone handling the body of the deceased. Similarly, it is anticipated that, even in the early stages of body decomposition, there is an evolution of gases from the body which may contain components capable of communicating disease from the body of the deceased to persons in the area, which is especially applicable to persons preparing the body for interment or burial.

Another problem of potential risk occurs where significant decomposition of the body either has, or predictably will, take place before the body is finally laid to rest. For example, sometimes the body of the deceased is not found until enough time has elapsed that the body has decayed to an extent where normal embalming procedures are ineffective to retard the decay of the body enough to prevent significant evolution of gaseous products of decomposition until the body is laid to rest.

In still other cases, typically related to traumatic death, the body is significantly torn or dismembered, to the extent that normal embalming procedures are ineffective as far as temporarily preserving the body until the body can be laid to rest. Such traumatic deaths are most commonly associated with war, or with transportation accidents. Especially where the body is subjected to high impact such as with projectiles, or with explosions, the body is sometimes severely broken or dismembered.

In some cases of traumatic death, the body can be found expeditiously. In some cases, one or more parts may not be found at all, or may be found at a later time.

This invention addresses particularly all cases of traumatic death where significant breakage of the body has occurred, whether significant decomposition has begun by the time the body is found, or not. The problem to be dealt with in cases of significant body breakage is that normal embalming processes are ineffective to adequately retard the decomposition until the body is interred or otherwise laid to rest. This is because the circulatory blood vessels, which are used for the conventional embalming processes, no longer form a continuous circuit, at the breakage. Where significant body breakage has taken place, the circulatory system has also been broken to the point where it is ineffective for use in this typical embalming process.

Thus it is desirable to provide a way to handle bodies which will likely experience significant decomposition by the time the body has been interred.

It is especially an objective to provide some way to reduce exposure to gases emitted from the bodies of the deceased.

It is a further objective to provide, as an alternative to conventional embalming, another method of retarding the decomposition of the body of the deceased.

SUMMARY OF THE INVENTION

The invention is illustrated by an article of manufacture which is a body container comprising enclosing wall means, defining an enclosure. The enclosure is sealable to form a seal. The combination of the wall means and the seal is effective to prevent gases from being transmitted freely into or out of the body container. The body container further includes valve means for facilitating transmission of gases through the wall means at the valve means.

In some embodiments the valve means comprises a one-way valve effective to facilitate transmission of gases out of the body container. In some embodiments the valve means comprises a one-way valve effective to facilitate transmission of gases into the body container. The valve means may alternatively provide for transmitting gases into or out of the body container. The valve means may comprise, for example, a two-way valve. In that case, gases can be transmitted either in or out, and may alternate in either direction. Another way of providing both inwardly traveling gas and outwardly traveling gas is the use of a first one-way valve effective for transmitting gases out of the body container and a second one-way valve effective for transmitting gases into the body container.

Preferably the wall means comprises a plurality of rigid walls having sufficient strength and rigidity to maintain a functionally constant shape in volume in the body container under normal earth loading pressures accompanying the typical burial of human bodies. In preferred embodiments, the wall means comprises at least one wall defining sides and bottom of the body container. At least one of those wall means defining sides and bottom is convex, as viewed from outside the body container.

In the most preferred embodiment, the wall means comprises a receptacle, a lid, and means for sealing the lid to the receptacle. The preferred embodiments include floating hinge means hinging the lid to the receptacle whereby the lid can be drawn tight and sealed to the receptacle about facing surfaces of the receptacle and the lid; and especially including such surfaces adjacent the hinge means.

Preferably the sealing means extends about facing surfaces of the receptacle and the lid, and in combination with the facing surfaces, comprises a sealing joint. The preferred structure of the sealing joint includes at least one projection on at least one of the facing surfaces of the receptacle and the lid, at the joint. The projection extends toward the other of the receptacle and the lid.

The body container can include mechanical fasteners for mechanically fastening the lid to the receptacle.

The invention is further embodied in a process for handling a deceased body. The process comprises the steps of placing the body in a body container as described above, closing and sealing the body container, and thereby creating the seal, and evacuating a first gaseous composition from the body container, thereby creating a vacuum in the sealed body container.

The process can optionally include, after the evacuation, the step of transmitting into the body container a second gaseous composition different from the first gaseous composition. In some embodiments, the process includes selecting a second gaseous composition which is effective to retard decomposition of the body of the deceased.

The process can include, after the evacuation step, transmitting sufficient gas into the body container to create a positive internal gauge pressure inside the body container, whereby the positive internal gauge pressure exerts an outwardly directed force on the wall means. This outwardly directed force can be used to assist in breaking the seal and reopening the body container.

DETAILED DESCRIPTION OF THE ILLUSTRATED EMBODIMENT

Figure 1:
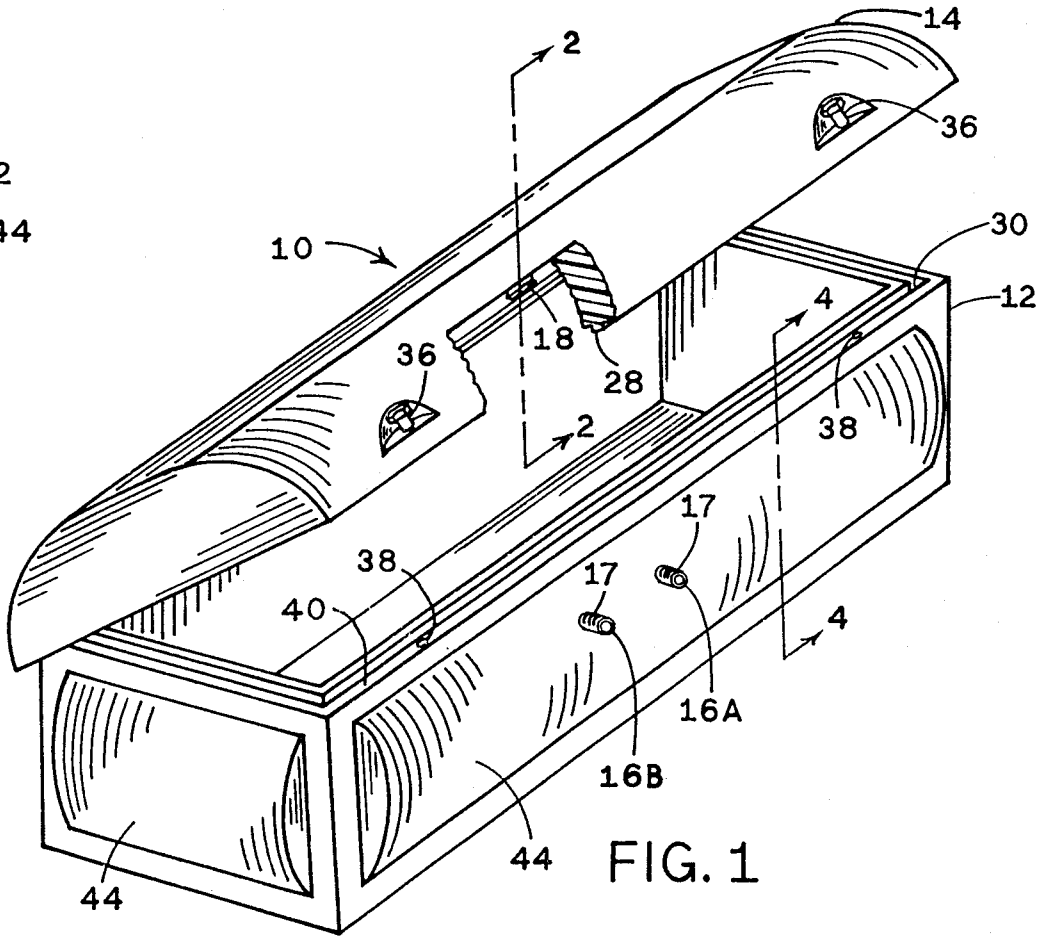
FIG. 1 shows a pictorial view of a body container of the invention with the lid partially opened.

FIG. 1 shows the body container generally designated 10, which includes a receptacle 12 and a lid 14. A pair of valves 16A and 16B are illustrated extending from the front surfaces of the receptacle. The lid 14 is mounted to the receptacle 12 by means of hinges 18.

Figure 2:
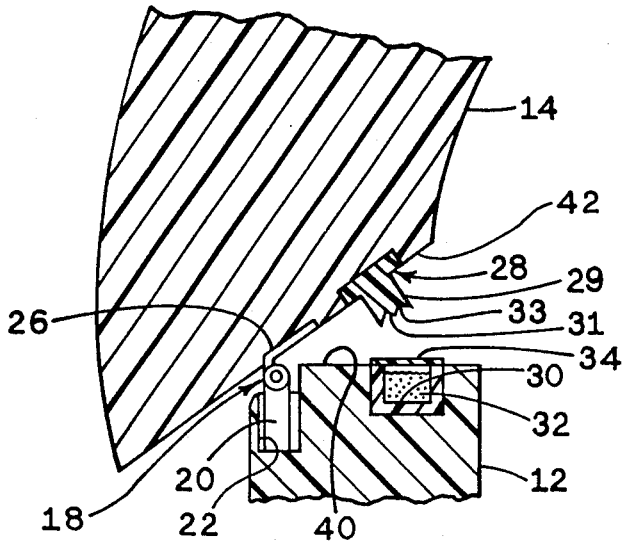
FIG. 2 is a fragmentary view taken at 2—2 of FIG. 1, and shows the hinge and the facing surfaces of the sealing means with the lid in the partially opened position.

Referring now to FIG. 2, the lower foot 20 of hinge 18 is positioned in hole 22 which is in receptacle 12. Hinge 18 pivots about pivot axis and pin 24 and is attached to lid 14 by means of upper hinge plate 26.

Upper projecting seal means 28 is mounted in lid 14 and projects toward lower receiving seal means 30 which is mounted in receptacle 12. Adhesive 32 is contained in lower receiving seal means 30, and is covered by a cover film 34 over the receiving seal means 30 as indicated in FIG. 2.

Bolts 36 on lid 14 are arranged for mechanically fastening lid 14 to receptacle 12 by means of bolt holes 38 in the receptacle 12, and for drawing the lid firmly down on receptacle 12. A second pair (not shown) of bolts 36 is arranged on the opposite (hinge) side of lid 14, and draws the hinge side of the lid down on receptacle 12. The number and spacing of the bolts is determined in accord with the amount of draw-down force desired.

Figure 4:
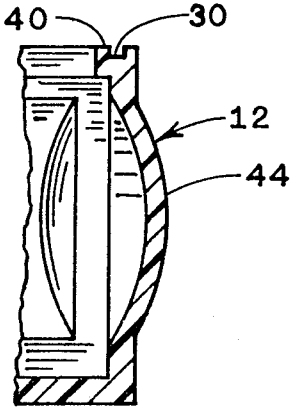
FIG. 4 a fragmentary cross-section of the receptacle and is taken at 4—4 of FIG. 1.

Referring now to both FIGS. 1 and 4, it is seen that the vertical walls of receptacle 12 are convex as viewed from outside the body container.

The body container 10 as illustrated in FIGS. 1–4 comprises wall means which define the enclosure when the body container is closed. It is specifically intended herein that the definition of the wall means includes that portion of the adhesive 32 which forms inner and outer surfaces with (i) the interior of the container and (ii) the exterior environment.

The functioning of the body containers of this invention is directed primarily at the health of individuals who have either incidental or prolonged contact with the body of the deceased, either directly or indirectly, until such time as the body is permanently laid to rest, either by interment in the ground, by cremation, or the like. The primary problem being dealt with relates to gaseous compositions which evolve from the body after death. The gaseous emissions of concern generally fall into two classes. The first class of emissions is the normal gases which result from the decomposition of the body. These gases are especially present where normal embalming processes are not functional to prevent decay of the body. This may occur where the body is not found for some time after death. This situation may also occur where the body has been severely broken or dismembered.

The second type of emission of concern is directed to all gaseous emissions coming from bodies of persons who have carried a communicable disease.

In either case, there is an especial concern for the safety of individuals who may come near, or contact the body of the deceased. The greatest risk is to individuals who prepare the body for the burial ceremonies, and who handle the body at any time before its final disposition. There is also concern for family and friends of the deceased who are near the body during services and ceremonies. It is desirable, for the safety of these people, that they have as little exposure as possible to gases evolved from the body of the deceased. Especially where the embalming process is either ineffective, or is only partially effective, it is important to shield the living from the gases being evolved.

In conventional practice, which uses a casket in combination with the sealed vault, typically the casket is not sealed. The casket is placed in the vault only after burial ceremonies have taken place.

Final disposition of the body, as by burial or cremation, may take place a few days after burial ceremonies. In winter, burial is desirably delayed until the ground thaws. Thus it is desirable to be able to hold bodies in, for example, a storage area for several weeks at a time, before burial. Where decomposition has advanced, or is advancing, it is especially desirable to be able to retard emission of the gases of decomposition through the joint which bridges the receptacle and the lid.

The sealing of the casket is known, and has been practiced, for example according to Clayton U.S. Pat. No. 3,892,417, where particular gasket material is used to provide an improved seal of the casket. However, in practice, even the advanced sealing materials used in conventional caskets, as in Clayton, do not prevent the leakage of gaseous materials out of the casket where substantial decomposition has taken place.

The achievement of this invention is that it provides a body container, as at 10 which is functional to provide a seal which substantially guarantees against the evolution of gases out of the burial container for at least a temporary time, regardless of the state of decomposition of the body.

Figure 3:
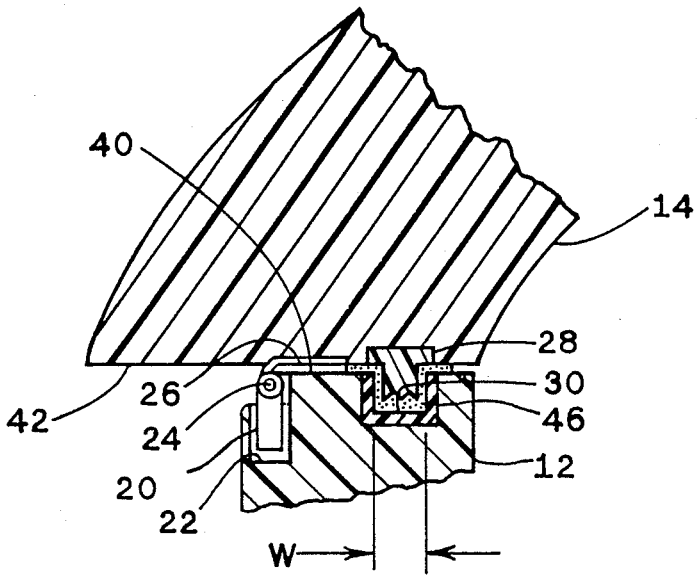
FIG. 3 a fragmentary view as in FIG. 2, with the lid having been closed.

Upper hinge plate 26 is securely fixed to the lid 14. Lower foot 20 of the hinge 18 is laterally confined in hole 22, but is allowed free vertical movement, as seen in comparing FIGS. 2 and 3. When lid 14 is opened, as seen in FIG. 2, foot 20 of hinge 18 reaches the bottom of hole 22 as seen in FIG. 2. When lid 14 is closed, as in FIGURE 3, hinge 18 is generally raised such that its lower foot 20 is above the bottom of hole 22. This position is seen in FIG. 3.

It is important in the preferred embodiments that hinge 18 be capable of vertical movement as the lid 14 is opened and/or closed, as will be seen hereinafter in combination with a discussion of the operation of the seal means 28 and 30, and adhesive 32.

The particular design and placement of hinges 18 are not critical so long as the hinges permit the lid to be drawn down on the receptacle, about the circumference of facing surfaces 40 and 42. Essentially, the hinges should freely float vertically, in some fashion, with respect to either receptacle 12 or lid 14. In the illustrated embodiment, gravity forms part of the joinder of hinge foot 20 to receptacle 12.

Upper and lower seal means 28 and 30 project about the circumference of lid 14 and receptacle 12, respectively. The circumferential extent of lower seal means 30 is seen about three sides of receptacle 12 in FIG. 1.

Adhesive 32 is positioned in lower seal means 30 as seen in FIG. 2. Prior to the joining of upper and lower seal means 28 and 30, and after the placement of adhesive 32 in lower seal means 30, the lower seal means 30 can be covered by a cover film 34 over the seal means 30 and adhesive 32, in order to prevent unnecessary handling, touching, dirtying, and the like of the adhesive 32. Cover film 34 can be removed prior to closing the body container. Alternatively, in some embodiments the cover film 34 can be left in place over receiving means 30, whereby the film is either pushed ahead of upper projecting seal means 28, or is pierced by projecting seal means 28, as the lid is closed.

Upper sealing means 28 includes a projecting portion 29 which projects from the lower surface 42 of lid 14. Projecting portion 29 preferably includes a plurality of ridges 31 and depressions 33 running along its length. Ridges 31 and depressions 33 are illustrated in FIGS. 2 and 3. The ridges and depressions provide a tortuous path to be negotiated by gases which could potentially leak through the seal. Accordingly, the surety or certainty of the seal is thus enhanced by the increased pressure at depressions 33 and the more tortuous path defined by the combination of the ridges 31 and depressions 33.

In the sealed body container as in FIG. 3, adhesive 32 defines an elongated seal path 46 extending down one side of seal means 30, across its width (W) and upwardly to the top of seal means 30. In preferred embodiments of this invention, elongated seal path 46 is at least 1.5, preferably at least 2, and most preferably at least 2.5, times the width (W).

In any event, as lid 14 is closed upon receptacle 12, upper projecting seal means 28 engages lower receiving seal 30 and its contained adhesive 32. As the projecting seal means 28 projects farther and farther into the lower receiving seal means 30, it forces the adhesive 32 to flow out of the lower seal means 30 and into the space between the top 40 of the receptacle 12 and the bottom 42 of lid 14, as seen in FIG. 3. As the adhesive 32 flows out of lower receiving seal means 30, it functions, not only as an adhesive, but also as a sealing filler between upper surface 40 of receptacle 12 and lower surface 42 of lid 14. Thus the adhesive serves somewhat of a caulking function in the sealed joint.

Adhesive composition 32 has a paste consistency such that it can flow and deform when subjected to the pressure of projecting seal means 28 in the receiving seal means 30. The adhesive should have strong tack as well as excellent caulking qualities. Thus the adhesive is soft enough to flow and deform under pressure and solid enough that it will hold its shape without necessarily being contained by containing walls. The adhesive is thus generally considered to be a flowable solid, capable of complete change of shape according to its surroundings, including surrounding pressures.

Suitable adhesives are generally known for use with burial vaults, and such adhesives are generally satisfactory for use in this invention. Typical of such adhesives is GS Number 4 general purpose sealant from General Sealants Incorporated, Los Angeles, Calif. GS-4 has a base material of butyl rubber and is 100% solids.

It is seen in FIGS. 2 and 3 that the upper and lower seal means 28 and 30 can comprise separate elements which are set in respective grooves cut in the receptacle 12 and the lid 14. The seal means 28 and 30 accordingly form secondary seals between themselves and the respective grooves within which they reside. It is seen in FIG. 3 that the adhesive 32 preferably spreads enough to cover the intersection of the joints between the seal means 28 or 30, and the respective groove, with the surface of the lid or receptacle in which they reside. Accordingly, adhesive 32 prevents the leakage of gases not only past the seal means 28 and 30 where they meet each other, but also where the respective seal means 28 and 30 meet the respective ones of the lid and the receptacle in the respective grooves.

In forming the seal, the adhesive is first caused to flow by the weight of the lid 14 as the lid comes down on the top surface 40 of the receptacle 12, whereby the adhesive 32 is engaged by the upper projecting seal means 28. After the lid 14 has been closed on the receptacle, with the engagement of the upper and lower seal means 28 and 30, the lid is mechanically drawn down on, and fastened to, the receptacle by tightening of bolts 36 in bolt receiving holes 38. As the bolts are tightened, thus tightening lid 14 on receptacle 12, a further compression of the adhesive 32 typically occurs in the joint area, namely between the facing surfaces of seal means 28 and 30, and between the facing surfaces 40 and 42 of the receptacle and the lid, respectively. Upon the completion of the closure process as indicated above, the body container is closed and sealed, effective to prevent gases from being transmitted freely into or out of the body container. Once the body container has been established as a closed and sealed unit, the gases in the container can then be controlled by means of valves 16A and 16B. According to the illustration of FIG. 1, valve 16A is a conventional one-way check valve, well known in the industry. Valve 16A is installed such that the air contained within the body can be evacuated by means of a vacuum pump. Accordingly, as a one-way valve it prevents the entrance of air or the like into the body container. Valve 16B is a one-way check valve similar to valve 16A, except that it has the capability of allowing air to be passed into the container in the opposite direction to gas passed through valve 16A. As seen in FIG. 1, valves 16A and 16B include attachment means such as threads 17 which extend to and/or from the outside of the body container. Thus an air handling unit such as a vacuum pump is readily used with one of the valves 16A, 16B, whereby to increase or decrease the absolute pressure (e.g. positive or negative gauge pressure) inside the body container. Valves 16A and 16B have conventional threshold pressure differentials which must be overcome before there is any passage of gas in the given direction. Since the one-way check valves used in this invention are conventionally available hardware items, no further description of those items is necessary.

While the process of the invention can be practiced with virtually any amount of vacuum, it is preferred that the body container be evacuated to an absolute pressure of no more than about 8 inches, preferably no more than 4 inches, and most preferably no more than 2 inches of mercury.

After the body container has been sealed closed, as described above, the gaseous contents of the container can be withdrawn, as by a vacuum pump, through valve 16A.

The withdrawal of the air inside the body container accomplishes a plurality of functions. First, as the air is withdrawn, and a vacuum is thereby created in the body container, the pressure differential across the container walls draws the lid more tightly onto the receptacle, whereby the integrity of the seal formed by adhesive 32 is enhanced.

Second, with a vacuum existing inside the body container, any gases evolved from the body of the deceased will only reduce the amount of the vacuum, and typically will not create a positive gauge pressure inside the body container for a significant amount of time, whereby the leakage of gases of decomposition out of the body container is retarded for that period of time. The greater the vacuum drawn, the greater the amount of gases of decomposition that can be evolved from the body before a positive gauge pressure exists in the body container.

Third, the withdrawal of air, and accordingly oxygen, from the body container will tend to starve those decomposition processes which rely on oxygen as one of the agents active in the decomposition. Thus the progression of aerobic decomposition processes (namely those depending on the use of oxygen) will be retarded as long as the oxygen supply is thus depleted. This retardation of aerobic decomposition processes serves as a type of preservation process which does not depend on the circulatory system of the body to retard the decomposition.

In some cases, it will be desirable to evacuate the body container for a temporary period of time and then to open the body container for further treatment of the body at a later time. In these cases, it can be desirable to use valve 16B for the purpose of creating a positive gauge pressure inside the body container and thereby using the gauge pressure as an assist in breaking the seal at adhesive 32. In those embodiments, a modest amount of air pressure is introduced into the body container by way of valve 16B before the seal is broken.

In an alternative embodiment of the process of treating the body of the deceased in the body container of this invention, it is within the scope of this invention to employ different gases inside the body container for the purpose of retarding the decomposition of the body, or for absorbing products of decomposition. Accordingly, it is contemplated to use an inert gas, such as nitrogen or helium, which does not play an active part in the decomposition process. It is also contemplated to use gases which are reactive, either chemically or adsorptively, with the gases of decomposition, thereby converting the gases evolved from the decomposition into compounds of a less objectionable nature. When a gas is to be introduced into the body container in order to perform one or more of the above functions, it is contemplated that the air and the like initially contained in the container will be withdrawn first by means of a vacuum withdrawal. Thus the process includes the steps of withdrawing the air contained when the body container is sealed closed, followed by the insertion of the desired gas into the body container to the desired pressure and composition.

Valves 16A and 16B can be combined into a single two-way valve which can be used either for drawing a vacuum or for applying a positive gauge pressure. Such two-way valves are also conventionally well known in the art and need not be further described here.

The body containers of this invention encompass embodiments which are contemplated to serve in the place of both the conventional casket and the vault. Typically the casket has little or no capability to seal against gas leakage. The casket typically is not able to permanently withstand the ground pressures which occur in cemetery burial. Thus the casket is typically placed in a highly durable vault which is sealed in well-known manner before it is placed in the ground at the grave-site. Using the principals of this invention, it is no longer necessary to provide a separate sealed body container for use at the grave-site. Rather, the body containers of this invention preferably are used as a single body containing unit which serves as both the casket and the vault. Accordingly, the body containers of this invention are anticipated to be relatively strong and durable. A conventional material which can be used in fabrication of body containers of this invention are various of the plastics. Anticipated as being of particular use are the polyolefins and especially the polyethylenes and polypropylenes.

If desired, the body containers of the invention are compatible such that they can be used with conventional burial vaults.

Also in accordance with preferred embodiments of this invention, the walls of the body container can be so constructed as to enhance their strength and durability with respect to the vacuum pressure differential, and with respect to pressures experienced with underground burial. FIG. 4 illustrates that the walls 44 of body container 10 are preferably convex when viewed from outside the body container. As seen in FIG. 1, the front wall and one side wall of the body container are illustrated as being convex. Preferably the other walls can also be convex in order to minimize the amount of material which must be used in obtaining the necessary strength against the maximum anticipated pressure differential.

For mausoleum use, and wherein the body container will not be subjected to the underground pressures, lighter wall construction will be acceptable, so long as the seal and the container integrity are maintained.

While some decomposition of the body may continue to occur during the time the body is in the evacuated body container, the amount of decomposition gas escaping to the outside environment, from inside the sealed body container, is thus greatly reduced, and in some cases totally eliminated, over the period during which the body is prepared for burial and the burial ceremonies are performed. Thus the exposure of both the workers involved in caring for the body and the family and friends of the deceased, is accordingly reduced, as long as the body container remains sealed.

It is contemplated that there may be some emission of gases from the body before the body is laid to rest. It is, however, anticipated that the evolution of such gases will be of such small volume that either a vacuum will continue to be maintained, or that any positive pressure inside the body container will be small enough that there will be essentially no leakage past the seal formed by the adhesive 32.

Thus the body containers of the invention provide the capability to temporarily store, or transport a body with substantially reduced risk of the exhausting of gases of the decomposition from the body container. This substantially reduced risk of exhausting of gases from the body container reduces the risk of odors or disease carrying particles from being released from the sealed container.

This sealing of the body container further provides, in preferred embodiments, for the replacement of the combination of the casket and the vault with a single body containing unit which can be placed directly into the burial plot in the cemetery.

Yet again, the exclusion of oxygen from the environment of the body container provides for retarding of aerobic decomposition of the body so long as the vacuum is maintained, or oxygen is denied to the contents.

The seal of the body containers of this invention is preferably formed in the following stages.

1. The upper and lower sealing means 28 and 30 are engaged, and spreading of adhesive 32 is begun.
2. Bolts 36 are engaged and tightened all around the circumference of lid 14, generally further compressing and spreading adhesive 32.
3. Vacuum is then drawn through valve 16A.
4. Bolts 36 are then optionally retightened, the process then being complete.

When formation of the seal has been completed by the above process, the seal is maintained by the combination of the mechanical holding of bolts 36 and the inward pressure on the outside of container 10, as effected by the drawn vacuum. Once the seal is thus formed, by the above combination of forces, the seal is effectively maintained by bolts 36 essentially independent of the internal pressure, or vacuum, inside container 10.

In the most common use contemplated for body containers of this invention, the air will be evacuated to create a vacuum, and the interior of the container will generally be held in an evacuated condition. As gases of decomposition are evolved from the body, they will reduce the amount of vacuum. But the body container will be able to maintain a net vacuum condition until the volume of the evolved gases equals the volume of the air previously evacuated.

Thus, where a vacuum is initially drawn to 3 inches of mercury, whereby about 90% of the air is evacuated, then the body container can absorb gases of evolution (at ambient conditions) up to about 90% of the net volume of the body container before the initial vacuum was drawn. If no vacuum is drawn, as in a conventional body container, a sealed container will exhibit a positive gauge pressure with virtually any evolution of gases of decomposition.

Where, for example, a vacuum is drawn to 3 inches of mercury, absolute pressure, about 90% of the air has been withdrawn from the body container. And an equivalent volume of gases can be evolved from the body at ambient conditions before the vacuum is eliminated, and neutral pressure reached. Until such time as the vacuum is eliminated, the body container of this invention operates in a manner superior to body containers not having vacuum capability, in that the possibility of gaseous leakage out of the body container is nil, and in that aerobic decomposition is retarded for lack of oxygen.

Further evolution of gases after neutral pressure is reached does result in a positive contained pressure. But that pressure is maintained inside the body container by the secure seal at adhesive 32. Further, precious time has been gained for treatment and disposition of the body before the positive pressure is reached. In any event, the pressure is less than if no vacuum had been drawn. The amount less can be estimated according to the amount of vacuum drawn, with further allowance for the retardation of aerobic decomposition.

If it is necessary to maintain a vacuum in the body container, the container 10 can be evacuated again, and as often as necessary to so maintain the vacuum. Similarly, the body container can be re-evacuated prior to opening it, to remove gases of decomposition, and air or other gas, not containing gases of decomposition, then injected into the container through valve 16B to reach neutral or positive pressure with the outside environment, as discussed above prior to opening the container.

During any evacuation, and especially after the first evacuation, and where gases of decomposition are present, it is desirable to pass the evacuated gases through appropriate, and conventionally known, filter media, or other separation equipment, to remove objectionable gases or gaseous particles, before exhausting the balance of the evacuated gases to the environment.

The vacuum body containers of this invention are thus suitable for use for handling any body which possesses, or will possess, compounds or compositions which are objectionable, or dangerous to living people. Accordingly, the body containers are especially useful where the body has been significantly broken or where significant decay or decomposition of the body has occurred. Further, the body containers are useful for containing bodies killed by agents of chemical or biological warfare, and wherein the chemical or biological agent may continue to pose a threat to individuals handling the body.

While the invention has been described above with respect to its preferred embodiments, it will be understood that the invention is capable of numerous rearrangements, modifications, and alterations, and all such arrangements, modifications, and alterations are intended to be within the scope of the appended claims.

Having thus described the invention, what is claimed is:

1. A body container, said body container comprising enclosing wall means defining an enclosure, said enclosure being sealable to form a seal, the combination of said wall means and said seal being effective to prevent gases from being transmitted freely into or out of said body container, and including valve means having attachment means extending to the outside of said body container, said valve means being adapted to facilitate transmission of gases through said wall means at said valve means.

2. A body container as in claim 1 wherein said valve means comprises a one-way valve effective to facilitate transmission of gases out of said body container.

3. A body container as in claim 1 wherein said valve means comprises a valve effective to facilitate transmission of gases into said body container.

4. A body container as in claim 1 wherein said valve means can facilitate transmission of gases into, and out of said body container.

5. A body container as in claim 4 wherein said valve means comprises a two-way valve.

6. A body container as in claim 4 wherein said valve means comprises a first one-way valve effective for transmitting gases out of said body container and a second oneway valve effective for transmitting gases into said body container.

7. A body container as in any one of claims 1–6, said wall means comprising a plurality of rigid walls, said walls having sufficient strength and rigidity to maintain a functionally constant shape and volume in said body container under normal earth loading pressures accompanying burial of human bodies.

8. A body container as in claim 7, said wall means comprising at least one wall defining sides and bottom of said body container, at least one said wall defining sides and bottom of said body container being convex, as viewed from outside said body container.

9. A body container as in any one of claims 1–6, said wall means comprising a receptacle, a lid, and means for sealing said lid to said receptacle, and including floating hinge means hinging said lid and said receptacle, whereby said lid can be drawn tight, and sealed to said receptacle about facing surfaces of said lid and said receptacle, including such surfaces adjacent said hinge means.

10. A body container as in claim 9, and including mechanical fasteners for mechanically fastening said lid to said receptacle.

11. A process for handling a body, said process comprising the steps of:

(a) placing the body in a body container, said body container comprising wall means defining an enclosure, said enclosure being sealable to form a seal, the combination of said wall means and said seal being effective to prevent gases from being transmitted freely into or out of said body container, and including valve means for facilitating transmission of gases through said wall means at said valve means;

(b) closing and sealing said body container, thereby creating a seal; and (c) evacuating a first gaseous composition from said body container, thereby creating a vacuum in said body container.

12. A process as in claim 11 and including, after said evacuation of step (c), transmitting, into said sealed body container, a second gaseous composition, different from said first gaseous composition.

13. A process as in claim 11 and including, after said evacuation of step (c), transmitting sufficient gas into said body container to create a positive internal gauge pressure inside said body container, whereby said positive internal gauge pressure exerts an outwardly directed force on said wall means.

14. A process as in claim 13, and including using said positive internal gauge pressure to assist in breaking said seal and reopening said body container.

15. A process as in claim 11 and including selecting a second gaseous composition which is effective to retard the rate of decomposition of the body of the deceased, relative to the rate of decomposition in air; and, after said evacuation of step (c), transmitting said second composition into said sealed body container.

16. A process as in claim 11, and including the steps of:

(d) letting elapse enough time that decomposition gases are present in said body container; and (e) evacuating said body container a second time.

17. A process as in any one of claims 11, 12, 15, or 16 and including the step of passing said evacuated gases through separation equipment effective to remove objectionable gases or gaseous particles from said evacuated gases.

18. A process for handling a body killed by agents of biological or chemical warfare, said process comprising the steps of:

(a) placing the body in a body container, said body container comprising wall means defining an enclosure, said enclosure being sealable to form a seal, the combination of said wall means and said seal being effective to prevent said agents of biological or chemical warfare from being transmitted freely into or out of said body container, and including valve means for facilitating transmission of gases through said wall means at said valve means;

(b) closing and sealing said body container, thereby creating a seal;

(c) evacuating contained gases from said body container, thereby creating a vacuum in said body container; and (d) passing said evacuated gases through separation equipment effective to remove said agents of biological or chemical warfare from said evacuated gases.

19. A body container, comprising:

(a) a receptacle;

(b) a lid;

(c) seal means adapted to seal said receptacle to said lid; and (d) vertically floating hinge means, hinging said lid and said receptacle.

20. A body container as in claim 19, said seal means comprising an adhesive capable of complete change of shape according to its surroundings.

21. A body container as in claim 19, and including tightening means, separate from the hinging function of said hinge means, adapted to drawing said lid and said receptacle tightly together about facing surfaces of said lid and said receptacle, including such surfaces adjacent said hinge means.

22. A body container comprising enclosing wall means defining an enclosure, said enclosure being sealable to form a seal, the combination of said wall means and said seal being effective to prevent gases from being transmitted freely into or out of said body container, and including valve means adapted to facilitate transmission of gases into said body container when said body container is sealed.

23. A body container as in claim 22 wherein said valve means extends to the outer surface of said wall means and is adapted to facilitate transmission of gases into, and out of said body container.

* * * * *